US009659480B2

(12) United States Patent
Luna et al.

(10) Patent No.: US 9,659,480 B2
(45) Date of Patent: May 23, 2017

(54) REMINDERS BASED ON VIRTUAL LOCATIONS

(71) Applicant: Lenovo (Singapore) Pte. Ltd., Singapore (SG)

(72) Inventors: Joaquin F. Luna, Raleigh, NC (US); Grigori Zaitsev, Durham, NC (US); Rod D. Waltermann, Rougemont, NC (US); Brian Alan Burdette, Apex, NC (US); Rachael Marie Luna, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 14/330,496

(22) Filed: Jul. 14, 2014

(65) Prior Publication Data

US 2016/0012709 A1 Jan. 14, 2016

(51) Int. Cl.
*G08B 21/24* (2006.01)

(52) U.S. Cl.
CPC ..... *G08B 21/24* (2013.01)

(58) Field of Classification Search
CPC ..... G06Q 10/109; G06Q 10/1091; G06Q 10/1093; G06Q 30/0217; G06Q 30/0261; G08B 21/24; G09B 29/007; G09B 29/10; H04W 4/02; H04W 4/12; H04W 4/206; H04W 60/04; G01C 21/3682
See application file for complete search history.

(56) References Cited

U.S. PATENT DOCUMENTS 6,363,352 B1 * 3/2002 Dailey ..... G06Q 10/1095 705/7.19
2002/0120351 A1 * 8/2002 Tuomela ..... G06Q 10/109 700/16
2008/0147311 A1 * 6/2008 Zoller ..... G01C 21/3682 701/533
2010/0102953 A1 * 4/2010 Chou ..... G08B 21/24 340/539.11
2013/0006736 A1 * 1/2013 Bethke ..... A63F 13/12 705/14.12
2013/0185772 A1 * 7/2013 Jaudon ..... H04L 67/08 726/4
2014/0070945 A1 * 3/2014 Dave ..... G08B 21/24 340/540
2014/0094192 A1 * 4/2014 Annett ..... H04W 4/028 455/456.3
2015/0112783 A1 * 4/2015 Nikolaev ..... G06Q 30/0217 705/14.19
2015/0200892 A1 * 7/2015 Ramachandran ..... H04L 51/14 709/206

* cited by examiner

*Primary Examiner* — Van Trieu
(74) *Attorney, Agent, or Firm* — Ference & Associates LLC

(57) ABSTRACT

One embodiment provides a method, including: obtaining, using a processor, a reminder, the reminder being triggered by a later access to a virtual location; thereafter determining, using a processor, a user is accessing the virtual location; and providing, using a processor, the reminder to the user. Other embodiments are described and claimed.

20 Claims, 3 Drawing Sheets

REMINDERS BASED ON VIRTUAL LOCATIONS

BACKGROUND

Currently some information handling devices ("devices"), for example, smart phones, cellular phones, tablets, laptop computers, personal digital assistants (PDAs) and the like, have the ability to display a reminder to a user. For example, many portable information handling devices have personal assistants that assist users with setting up reminders tied to a particular time or geographical location. A timed reminder is displayed when a certain time and day are met. A geographical reminder is displayed when a user enters a certain geographical location. A user also has the ability to create a to-do list, but these generally have to be manually consulted, meaning, a user has to remember to consult the to-do list. While these reminders, personal assistants, and to-do lists are helpful in reminding users to accomplish a task, they do not cover every situation in which a user may want a reminder.

BRIEF SUMMARY

In summary, one aspect provides a method, comprising: obtaining, using a processor, a reminder, the reminder being triggered by a later access to a virtual location; thereafter determining, using a processor, a user is accessing the virtual location; and providing, using a processor, the reminder to the user.

Another aspect provides an information handling device, comprising: an output device; a processor operatively coupled to the output device; and a memory storing instructions executable by the processor to: obtain a reminder, the reminder being triggered by a later access to a virtual location; thereafter determine a user is accessing the virtual location; and provide, using the output device, the reminder to the user.

A further aspect provides a product, comprising: a storage device having code stored therewith and executable by a processor, the code comprising: code that obtains a reminder, the reminder being triggered by a later access to a virtual location; code that thereafter determines a user is accessing the virtual location; and code that provides the reminder to the user.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
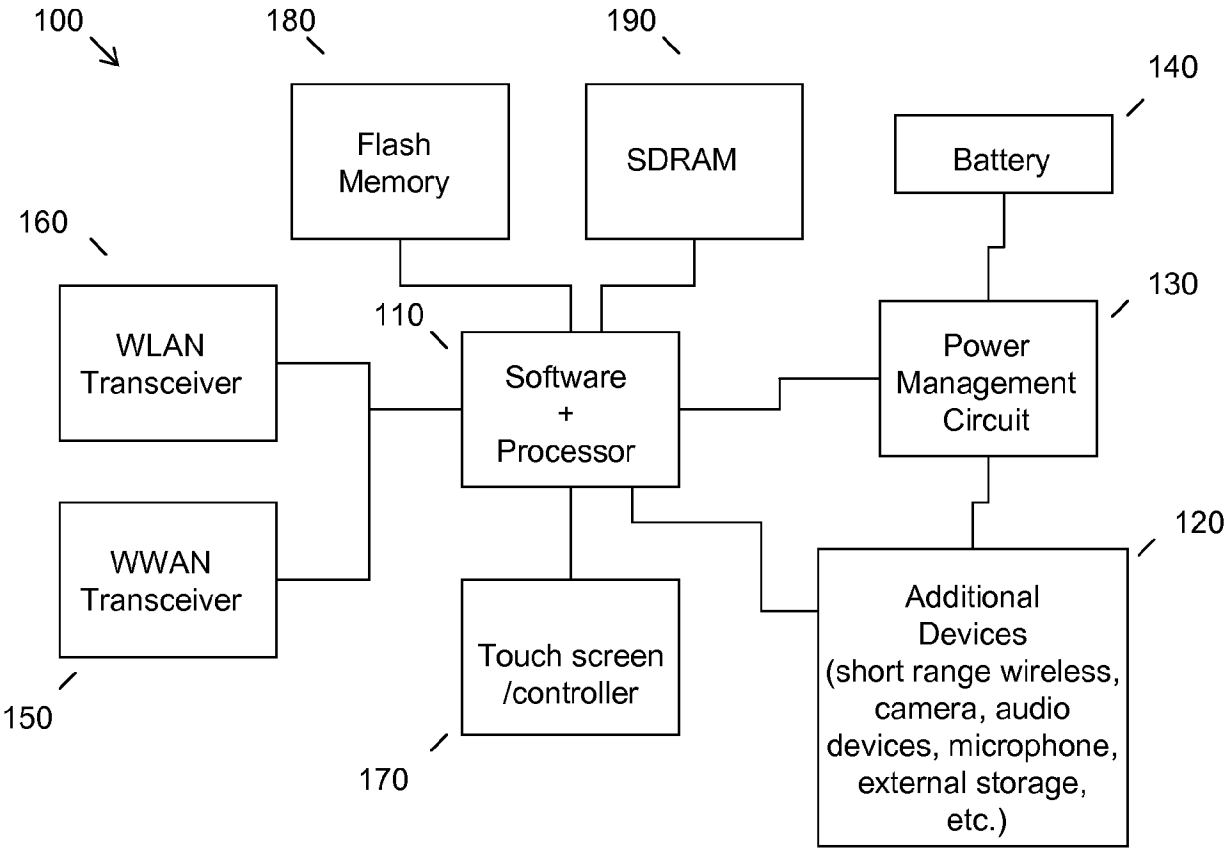
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

People use information handling devices to help remind them to accomplish a task. For example, users can set reminders on calendars. The reminders may be displayed when a certain day or time is reached. Personal assistants, for example, SIRI, CORTANA, GOOGLE Now, and the like, installed on some portable information handling devices (e.g., tablets, smart phones, laptop computers, personal digital assistants (PDAs), etc.), may assist a user by allowing the user to set a reminder and then reminding the user of that particular task once certain parameters are met. For example, a user may be able to set a reminder to be displayed when a certain geographical location is reached. By way of example, a user can set a reminder to be displayed when the user enters a grocery store reminding them to buy milk. SIRI is a registered trademark of Apple Inc. in the United States and other countries. CORTANA is a registered trademark of Microsoft Corporation in the United States and other countries. GOOGLE is a registered trademark of Google Inc. in the United States and other countries.

A user may also be able to set up a to-do list located within an application or as a stand-alone application on an information handling device. However, the to-do list must be accessed manually. This means that a user has to remember to consult the to-do list on a periodic basis. Alternatively, a user may set up a reminder to check the to-do list, but this requires extra steps.

Currently information handling devices, such as laptop computers, personal computers, tablets, smart phones, PDAs, and the like, do not allow a user to set a reminder for when the user accesses a virtual location (e.g., online shopping site, online gaming location, a particular application, etc.). Additionally, the reminders and to-do lists cannot be accessed across different information handling devices. For example, if a user sets a reminder to buy milk at the grocery store on their tablet, but then takes their smart phone to the grocery store rather than the tablet, the user will not be reminded of the task. The user would be required to set the same reminder on any device that the user may use.

Accordingly, an embodiment provides a method of receiving a user input (e.g., voice communication, text based communication, click input, gesture input, etc.) associated with the user accessing a virtual location, for example, an online shopping site, an application, an online gaming site, and the like. For example, a user may make note of something the user wants to do when the user accesses their banking website. An embodiment may then store the user input until the user accesses the virtual location. For example, the user accesses their banking website. An embodiment may provide the user with their user input, e.g., a reminder corresponding to the initial user input. For example, an embodiment may display the previously saved reminder when the user accesses their banking website.

An additional embodiment may detect a second information handling device where the user input was originally stored. For example, the user may put a reminder on their smart phone. The user may then be currently using their tablet. The tablet may detect the smart phone (e.g., the devices are connected to the same network, the devices are connected together using a cable, the devices communicate using wireless communication, are part of a personal network linked via a cloud account, etc.). The first information handling device may then receive the user input from the second information handling device. For example, the tablet may receive the user input from the smart phone. For simplicity this is discussed as just two information handling devices, but this should not be construed to limit the various embodiments to just two information handling devices. The user input may then be stored on both information handling devices. Therefore, in an embodiment, when the user presence is co-located with the virtual location with either device, an embodiment may provide the user with the user input. For example, if the user accesses the location denoted in the user input with either the smart phone or tablet, the user input will be provided on that device.

In a further example embodiment, after the reminder/user input is provided to the user, a user interface may be displayed. This user interface may provide selections for the user to provide input. In one example embodiment, a selection may allow a user to ignore or acknowledge the provided user input. In the case of ignoring or acknowledging the provided reminder/user input, an embodiment may then remove the user input from memory storage. Additionally or alternatively, an embodiment may provide a user interface including a selection allowing the user to reset the reminder. In the case of resetting, an embodiment may then store the reminder until the user presence is co-located with the virtual location at a later time. In other words, an embodiment may allow a user to delay the reminder and remind the user at a later time.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120), for example a keyboard, camera, microphone, and the like, may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally devices 120 are commonly included, e.g., such as a camera, microphone, audio device, or other input devices. System 100 often includes a touch screen 170 for data input and display/rendering. System 100 also typically includes various memory devices, for example flash memory 180 and SDRAM 190.

Figure 2:
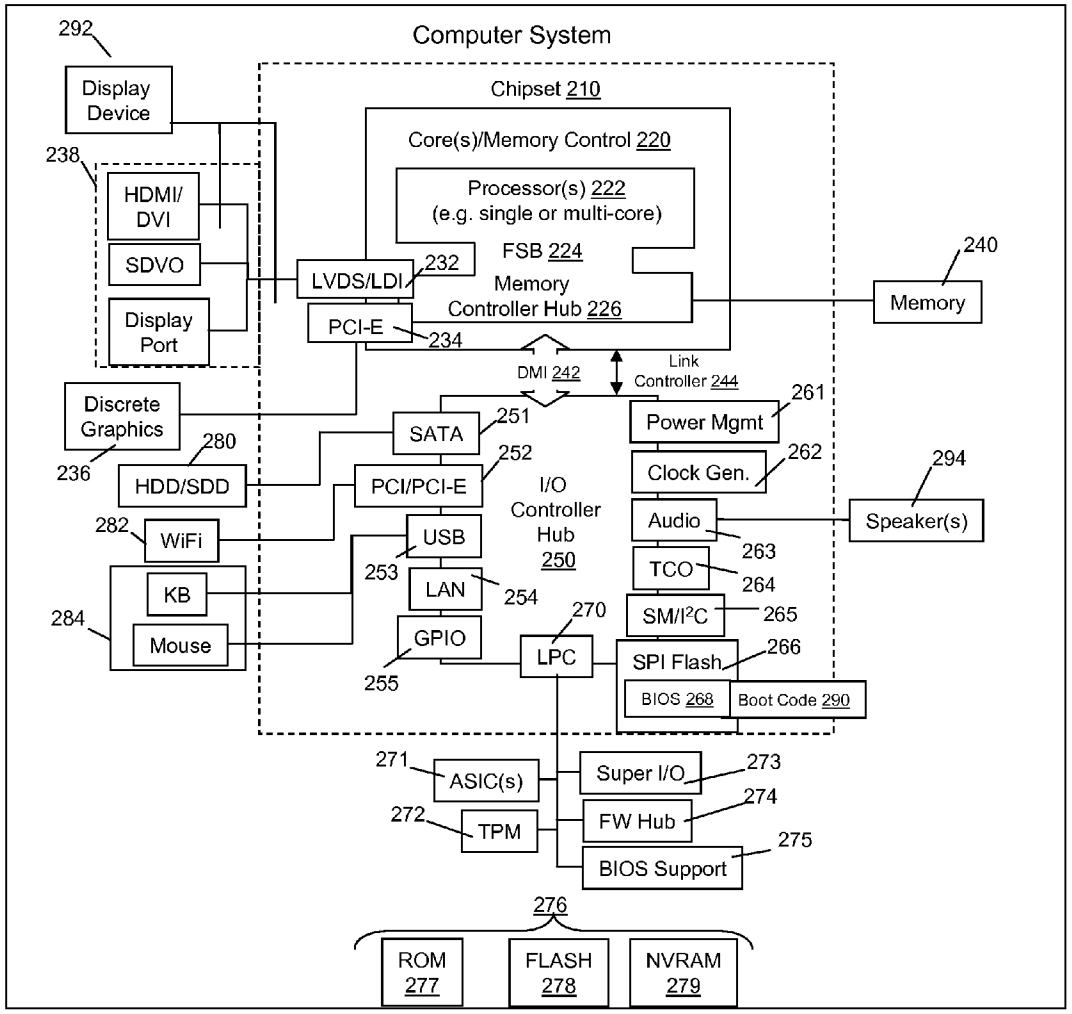
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a LVDS interface 232 for a display device 292 (for example, a flat panel display, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as tablets, smart phones, personal computer devices, generally, and/or other electronic devices which users use to access virtual locations, set up reminders, and the like, as described herein. For example, the circuitry outlined in FIG. 1 may be implemented in a tablet or smart phone embodiment, whereas the circuitry outlined in FIG. 2 may be implemented in a laptop personal computer embodiment.

Figure 3:
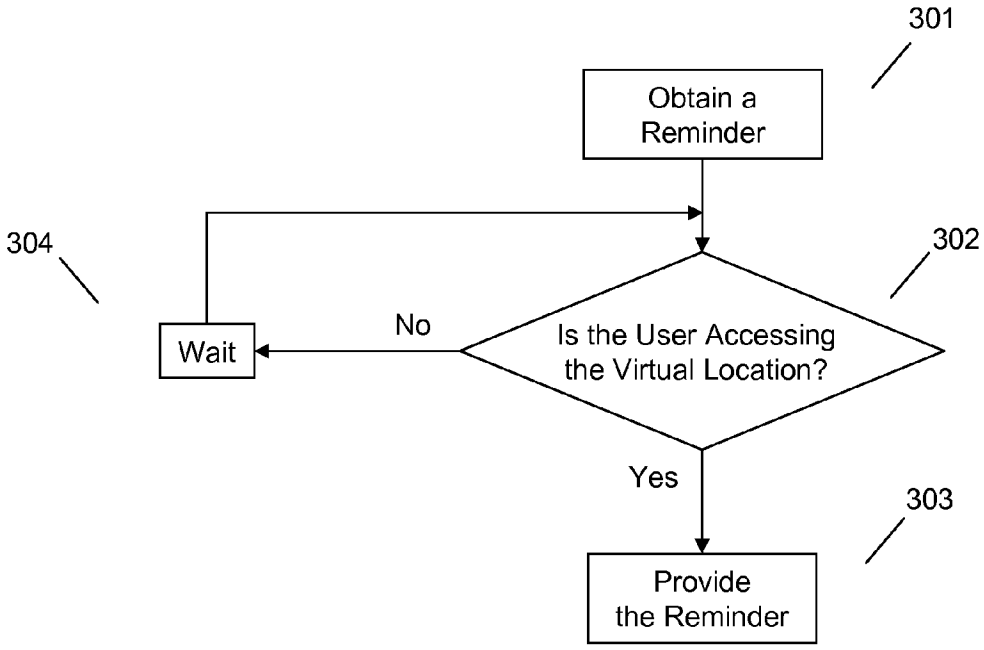
FIG. 3 illustrates an example method of providing reminders based on virtual locations.

Referring now to FIG. 3, an embodiment may use a processor to obtain a reminder at 301 (e.g., a note, reminder, calendar appointment, etc.). In one embodiment, a user may use a touch screen, such as 170 in FIG. 1, or a keyboard, such as 284 in FIG. 2, to input a text-based input. Additionally or alternatively, in one embodiment, a user may use a microphone, such as 120 in FIG. 1, or other audio input device to input a voice-based input. In one embodiment, the reminder is to be triggered by a later access (i.e., the user will access the virtual location at a time after obtaining the reminder) to a virtual location, for example, an online game, online website, application, and the like. For example, a processor may obtain a note relating to a user accessing a specific virtual location (e.g., banking website, social media mobile application, in-game location, etc.). Alternatively or additionally, in one embodiment the virtual location denoted in the reminder may be a type of virtual location. For example, the reminder may be to buy a music compact disc (CD), which may be triggered by a later access to a variety of virtual locations which sell music CDs. The virtual location may be a type of website (e.g., book store, banking website, etc.), a type of application (email application, word processor, etc.), or a type of game, rather than a specifically denoted website, application, or game.

In one embodiment, one device may obtain the user input at 301 from a second device. In one embodiment, the first device may detect a second device. This detection may be possible because the two (or more) information handling devices are connected together, for example, the devices are connected to the same network, the devices are connected together using a cable, the devices are connected using wireless communication methods, and the like.

In one embodiment, once the second device is detected the second device may send (directly or indirectly) the user input to the first information handling device. Additionally or alternatively, the first device may query (directly or indirectly) the second device for any possible user inputs/reminders associated with a user accessing a virtual location. If the second device is storing any such user inputs, the first device may receive them from the second device. For example, if a user has created a reminder on their PDA and is at home where they have a laptop, tablet, and smart phone on the same network, the laptop, tablet, and smart phone may communicate with the PDA in order to receive the reminder. This allows the user to provide a reminder on one device and any device they use to access the virtual location will provide them with the reminder.

Alternatively or additionally, in one embodiment, the reminder may be obtained through mining. In other words, an embodiment may use user patterns to determine that a reminder should be provided. For example, if a user always accesses their banking on the $15^{th}$ of the month to pay the cable bill, an embodiment may detect this pattern and automatically provide a reminder to the user to pay the cable bill when they access the banking site on or around the $15^{th}$ of the month. An embodiment may obtain the reminder through searching. For example, an application or other software may look to other applications to determine if reminders have been stored in the different location. Another example includes an application may search a document to determine if a reminder may need created. For example, an embodiment may search a user's email to determine that a bill due date is the $27^{th}$ of the month and may set up a reminder for this bill. An embodiment may obtain the reminder by identifying that user input is a reminder. For example, the user may create a note that says read examplebook. An embodiment may identify this as a reminder and provide the reminder to the user when the user accesses a location in which they can buy examplebook. These are just examples of how a reminder may be obtained and are not intended to be limiting.

At 302, an embodiment may determine whether the user is accessing the virtual location. A user accessing a virtual location may be associated with a user presence at the virtual location. For example, a user accessing a mobile application by providing device input to access (e.g., open, log into, etc.) an application. Thus, the user presence may also be considered to be the user logging into a virtual location requiring user credentials. For example, a user accessing their account on an online shopping site. Alternatively or additionally, the user presence may be associated with the user's online identity. For example, if a user plays an online game in which the user has an avatar. The avatar may be considered the user's online identity. Therefore, if the avatar were to access a specific in-game location (e.g., Faldir's Cove in WORLD OF WARCRAFT, Ashford Abbey in GUILD WARS, Makeinu Town in EVE ONLINE, etc.), an embodiment may associate this with the user presence in a given virtual location. WORLD OF WARCRAFT is a registered trademark of Davidson & Associates, Inc. in the United States and other countries. GUILD WARS is a registered trademark of NCsoft Corporation in the United States and other countries. EVE ONLINE is a registered trademark of CCP hf., Company in the United States and other countries.

In one embodiment the determining at 302 may be done by parsing the resource address (e.g., a website address, URL, etc.) and matching the resource address with data in the reminder. For example, if the reminder was a reminder to the user to buy shoes when the user accessed a specific website (e.g., "Buy new sneakers at exampleshoes.com"), an embodiment may compare the resource address included in the reminder to the website address that the user is accessing to determine if the user presence is accessing the virtual location (i.e., in this case, exampleshoes.com).

In one embodiment, the determining at 302 may be done by parsing the reminder and matching data of the reminder with data associated with the virtual location. One embodiment may parse the reminder and determine the keywords to determine which virtual location is intended to trigger the reminder. In other words, if, for example, a reminder includes keywords that may be associated with a virtual location, an embodiment may use those keywords to match to the virtual location. For example, if the reminder was a reminder to the user to pay the mortgage when the user accessed their banking website (e.g., "Pay mortgage at example bank"), an embodiment may parse the reminder and determine that "example bank" may be associated with a virtual location, e.g., a bank website or mobile application accessed by the user in the past. An embodiment may then monitor the user's virtual presence and if the user accesses the mobile application or website associated with "example bank" this would trigger the reminder. Alternatively or additionally, an embodiment may parse the reminder and determine a type of virtual location that would fit with the reminder. For example, if the reminder was a reminder to the user to buy a music CD, an embodiment may determine that the user could buy the music CD at five different stores and provide a reminder when the user accessed any one of these stores.

In one embodiment, if it is determined at 302 that the user is not accessing the virtual location, then an embodiment may do nothing at 304 and continue to monitor the user's virtual presence at 303. If, however, an embodiment determines that the user presence is accessing the virtual location at 303, an embodiment may provide the reminder to the user at 304. One example embodiment may provide a user interface including the reminder. For example, if the reminder is "Remind me to ask Mary about her uncle when I access FACEBOOK [a social media service]", if an embodiment determines that the user has accessed the FACEBOOK mobile application, or alternatively the FACEBOOK website address, using their user credentials, then an embodiment may display a user interface with the reminder "Ask Mary about her uncle." Alternatively, the user interface may show the reminder exactly as input by the user (i.e., in this example "Remind me to ask Mary about her uncle when I access FACEBOOK."). FACEBOOK is a registered trademark of Facebook, Inc. in the United States and other countries.

One embodiment, rather than displaying the reminder, may provide an audio output of the reminder. For example, if the reminder was received as an audio input or audio file, an embodiment may play that audio input or audio file when an embodiment determines that the user is accessing the virtual location. Alternatively, an embodiment may provide an audio output of the reminder that is not associated with an audio file of the reminder. For example, if the reminder is text-based, an embodiment may provide the reminder by "reading" the text-based input. Other methods of providing the reminder may be possible, e.g., using a different or combination of modalities.

An embodiment may additionally display a user interface including selections for the user. In one embodiment, the user interface may include selections for the user to adjust the reminder. For example, a user may ignore the reminder, remove the reminder, acknowledge the reminder, reset the reminder, adjust the location of the reminder, adjust the time of the reminder, and the like. For example, if the user ignores the reminder, then an embodiment may remove the reminder from memory, without taking any further action. If the user acknowledges the reminder, then an embodiment may open the reminder. Alternatively or additionally, an embodiment may remove the reminder from memory after the user acknowledges the reminder. Alternatively or additionally, the user interface may include a selection allowing the user to reset the reminder. An embodiment may then store the reminder until the user presence is co-located with the virtual location at a later time. For example, a user can reset the reminder and it will display again when the user accesses the virtual location later. Additionally, an embodiment may provide repeated or persistent reminders, e.g., remind the user to do something each time a virtual location is accessed, each time the virtual location is accessed in a given time frame (e.g., near the first of the month, etc.).

Accordingly, as illustrated by the example embodiments and the figures, an embodiment provides a method of obtaining (e.g., mining, searching, identifying, creating, etc.) a reminder (which is used broadly herein to encompass task reminders, notes, alerts, etc.) associated with the user accessing a virtual location. Once an embodiment determines that the user is accessing the virtual location, an embodiment may provide the reminder. Additionally, an embodiment provides a method in which the user can provide a reminder on one device, but that reminder is transmitted to multiple devices, so the user will be provided the reminder no matter what device they are using to access the virtual location. Additionally or alternatively, an embodiment may provide a method of obtaining a reminder that may not denote a specific location and will provide a reminder when a user accesses a virtual location in which the reminder could be completed. This provides a user a method of setting a reminder to accomplish a task at a virtual location (e.g., an online website, mobile application, game, etc.).

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages or may be machine code. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a general purpose information handling device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

obtaining, using a processor, a reminder comprising user based input related to an action to be taken by the user when accessing a virtual location, the reminder being triggered by a later access to the virtual location, wherein the reminder is created prior to accessing the virtual location;

thereafter determining, using a processor, a user is accessing the virtual location; and providing, using a processor, the reminder to the user.

2. The method of claim 1, further comprising transmitting the reminder between user devices.

3. The method of claim 1, further comprising transmitting the reminder between devices based on user entered identification information.

4. The method of claim 1, wherein the determining comprises parsing text of a resource address and matching the resource address with the reminder.

5. The method of claim 1, further comprising automatically suggesting a virtual location based on associating data of the reminder with a virtual location.

6. The method of claim 1, wherein the providing comprises displaying a user interface associated with the reminder.

7. The method of claim 6, wherein the user interface includes a selection that adjusts the reminder.

8. The method of claim 7, wherein the selection resets the reminder.

9. The method of claim 1, wherein the determining comprises detecting user input associated with user identification information accessing a user account.

10. The method of claim 1, wherein the virtual location is a location selected from the group consisting of: a website, a type of website, a game, a type of game, an application, and a type of application.

11. An information handling device, comprising:

an output device;

a processor operatively coupled to the output device; and a memory storing instructions executable by the processor to:

obtain a reminder comprising user based input related to an action to be taken by the user when accessing a virtual location, the reminder being triggered by a later access to the virtual location, wherein the reminder is created prior to accessing the virtual location;

thereafter determine a user is accessing the virtual location; and provide, using the output device, the reminder to the user.

12. The information handling device of claim 11, wherein the instructions are further executable by the processor to transmit the reminder between user devices.

13. The information handling device of claim 11, wherein the instructions are further executable by the processor to transmit the reminder between devices based on user entered identification information.

14. The information handling device of claim 11, wherein to determine comprises parsing text of a resource address and matching the resource address with the reminder.

15. The information handling device of claim 11, wherein the instructions are further executable by the processor to automatically suggest a virtual location based on associating data of the reminder with a virtual location.

16. The information handling device of claim 11, wherein to provide comprises displaying a user interface associated with the reminder.

17. The information handling device of claim 16, wherein the user interface includes a selection that adjusts the reminder.

18. The information handling device of claim 17, wherein the selection resets the reminder.

19. The information handling device of claim 11, wherein to determine comprises detecting user input associated with user identification information accessing a user account.

20. A product, comprising:

a storage device having code stored therewith and executable by a processor, the code comprising:

code that obtains a reminder comprising user based input related to an action to be taken by the user when accessing a virtual location, the reminder being triggered by a later access to the virtual location, wherein the reminder is created prior to accessing the virtual location;

code that thereafter determines a user is accessing the virtual location; and code that provides the reminder to the user.

* * * * *